United States Patent [19]

Gillis

[11] 4,308,647

[45] Jan. 5, 1982

[54] CLIP FOR GRIPPING FABRIC OR THE LIKE

[76] Inventor: Robert E. Gillis, P.O. Box 67, Aptos, Calif. 95003

[21] Appl. No.: 50,965

[22] Filed: Jun. 22, 1979

Related U.S. Application Data

[63] Continuation-in-part of Ser. No. 825,410, Aug. 17, 1977, Pat. No. 4,175,305.

[51] Int. Cl.[3] ..... A44B 21/00

[52] U.S. Cl. ..... 24/245 R; 135/15 CF

[58] Field of Search ..... 24/72.5, 243 K, 245 R, 24/245 A, 246, 113 R, 30.5 L, 263 R; 135/15 CF

[56] References Cited

U.S. PATENT DOCUMENTS

| | | | |
|---|---|---|---|
| 960,849 | 6/1910 | Dilg | 135/15 CF |
| 1,828,041 | 10/1931 | Hamacher | 24/245 R |
| 2,302,341 | 11/1942 | Nash | 24/245 R |
| 3,542,034 | 10/1970 | Klein | 24/245 R |
| 3,986,519 | 10/1976 | Gillis | 135/15 CF |

FOREIGN PATENT DOCUMENTS

| | | | |
|---|---|---|---|
| 548978 | 4/1932 | Fed. Rep. of Germany | 24/245 R |
| 189038 | 10/1959 | Sweden | 24/245 R |

*Primary Examiner*—Francis K. Zugel
*Assistant Examiner*—Alexander Grosz
*Attorney, Agent, or Firm*—Robert G. Slick

[57] ABSTRACT

A clip is provided which is adapted for fastening onto a flexible web such as a sheet of fabric. The clip is particularly adapted for fastening the fabric of a tent to supporting poles or stakes or for fastening webs together.

8 Claims, 5 Drawing Figures

CLIP FOR GRIPPING FABRIC OR THE LIKE

REFERENCE TO RELATED APPLICATION

This application is a continuation-in-part of my application Ser. No. 825,410, filed Aug. 17, 1977 now U.S. Pat. No. 4,175,305.

SUMMARY OF THE INVENTION

The present invention relates to a clip which can be used for fastening a ring-like member to a sheet of flexible material such as fabric. The clip was developed primarily for fastening loops, poles and stakes onto a flexible web to provide a connector suitable for use in a tent made in accordance with my Pat. No. 3,986,519. However, as will become later apparent, the invention is one of broad applicability and has many other uses.

Heretofore, it was ordinarily necessary in fastening a member on the fabric to penetrate the material in some way such as by sewing a loop onto the canvas or by piercing the canvas and placing washer-like members on each side of the canvas on a support member. Fasteners which do not penetrate the fabric ordinarily provide a weak connection which is easy to pull apart.

In accordance with the present invention, an improved fastener is provided which does not require penetration of the fabric in any manner so that the canvas is not weakened. Strain on either the fabric or the fastener actually increases the gripping power.

An object of the present invention is to provide a fastener for canvas or the like wherein the strain is distributed over a large area of the canvas so that maximum strength is attained.

Another object of the present invention is to provide a clip which is easily inserted or removed without marring the fabric so that it may be moved from one location to another without leaving any evidence of its use behind.

Another object of the present invention is to provide a clip which can be applied to fabric without the use of tools and with only simple hand pressure.

Still a further object of the invention is to provide a clip which is adapted to carry a multiplicity of attachments.

Another object is to provide a fastener which is reusable.

A still further object of the invention is to provide a clip which is simple to attach so that it can be put on by the user rather than the tent manufacturer, thus lowering production cost.

Still another object of the invention is to provide a clip which is adapted for securing two or more sheets of a flexible material together in a positive manner.

The clip of the present invention engages the fabric or other web between (a) mating flat surfaces on the two parts of the clip which are parallel to the surface of the web and (b) between mating collar surfaces at right angles thereto so that pulling on the female element will not cause the parts to become separated.

A still further object of the present invention is a clip which can be fabricated from a stiff material whereby the clip can be inserted or removed without distortion of the mating parts. Thus, the clip of the present invention can be made of a tough, inflexible plastic or can even be made of metal by known processes such as die-casting.

Other objects and features of the invention will be brought out in the balance of the specification.

DESCRIPTION OF THE PREFERRED EMBODIMENTS

Figure 1:
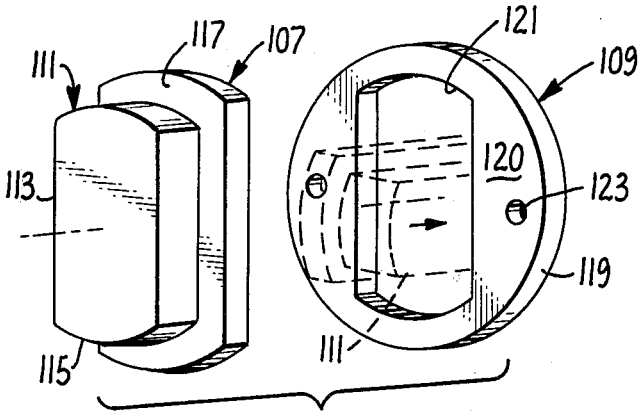
FIG. 1 is an exploded view of a fastener embodying the present invention.

The embodiment of the invention shown in FIG. 1 of the present specification is exactly that shown in FIG. 11 of my above-identified parent specification. In this embodiment of the invention, a plug or male element, generally designated 107, is employed with a female element, generally designated 109. The element 107 has a plug portion 111 and in this embodiment of the invention, the plug element 111 has straight sidewalls 113 and rounded end portions 115. It is obvious that the plug portion could be completely rectangular or, as is later explained in detail, preferably is oval. The male portion 107 also has a flat rim portion 117 surrounding the plug portion 111 forming a lip thereon. The female element 109 can be of any desired shape and in the embodiment shown is in the form of a circular disc 119 having an opening 121, the opening 121 being complementary to the shape and size of the plug portion 111. The disc 119 can contain one or more fastening holes 123. In order to use such a clip, the closest face 120 of the disc 119 would be pressed against the sheet of fabric to be clipped and the plug portion 111 pushed through the opening 121, as is shown in dot-dash lines in the right hand side of FIG. 1, carrying the fabric along with it. When the plug was completely through the opening, it would be turned 90° on two axes (spin and pitch) so that the plug portion 111 would extend back into the opening, 121 grasping the fabric between the two portions of the clip.

Figure 3:
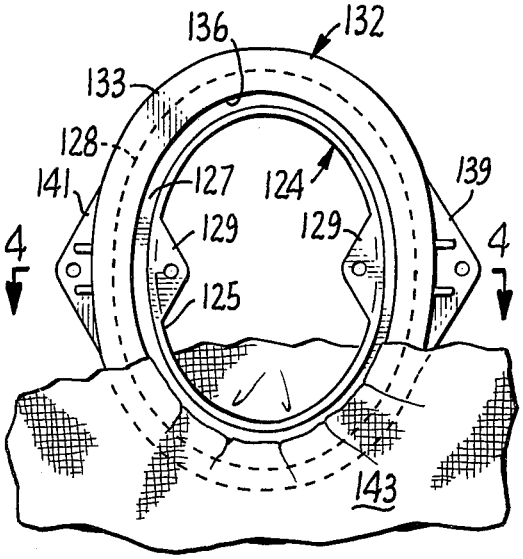
FIG. 3 is a plan view of the structure shown in FIG. 2.
Figure 2:
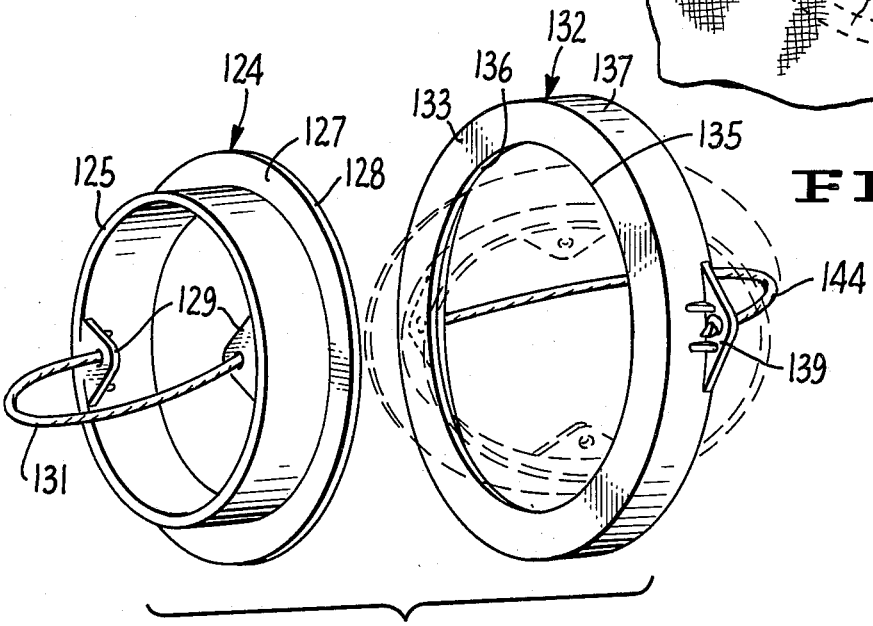
FIG. 2 is a similar exploded view showing another embodiment of the invention.
Figure 4:
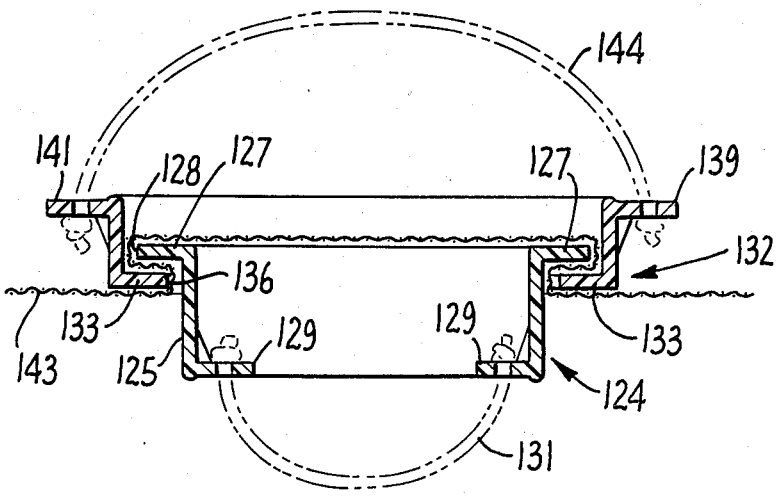
FIG. 4 is a section on the line 4—4 of FIG. 3.

Referring now to FIGS. 2, 3 and 4, a somewhat similar structure is shown wherein the male element 124 is in the form of an oval ring 125 with a rim 127 having an edge 128 at one side thereof. Opposite the rim 127 can be placed the inwardly turned lugs 129 which can support a loop 131 or other fastening device. The female element, which is generally designated 132, consists essentially of a ring 133 of oval shape having a central oval opening 135 with edge 136 which is complementary to the plug 125. It will be understood, of course, that the plug 125 does not form a tight fit in the opening 135 since room must be left for the fabric or other material which is gripped by the clip. Thus, the rim 133 has a lip 137 formed at the periphery thereof, the inner dimensions of the lip 137 being of such size that it forms a loose fit with the rim 127. The female element 132 may have one or more lugs for holding a fastening element. Typically two lugs are provided, namely 139 and 141, on opposite sides of the female element so that a rope or similar fastening element 144 can pass between the lugs. The device is used as was described in conjunction with FIG. 1 wherein the male element is turned at an angle, passed through the elongated female element and turned back to firmly grip the fabric.

The relationship of the parts and gripping relationship is clearly shown in the sectional view of FIG. 4. Here it will be seen that a piece of fabric 143 is firmly gripped between the two elements. The fabric surrounds both sides of the rim 133 and both sides of the rim 127 and is stretched taut across the opening of the male element. Since the gripping surfaces are substantially parallel throughout the peripheries of both elements, a strong attachment is made with a minimum of strain on the fabric.

The loops 131 and 144 are useful for attaching the clip to other objects. A typical application of the clip would be as part of a tent structure. Thus, 143 might be the fabric of the tent and the clip serves to fasten the clip, and thus the fabric, to the poles of the tent while the fastener 131 could extend inside the tent where it would be handy for hanging various articles.

Figure 5:
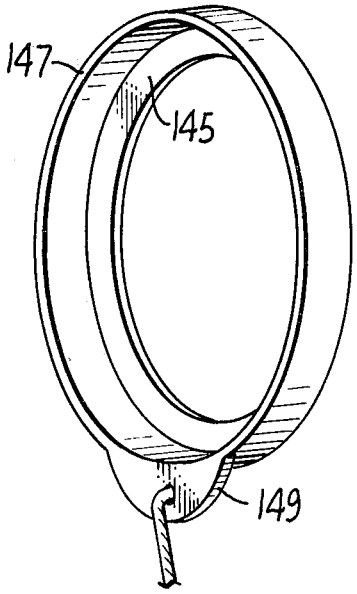
FIG. 5 is a perspective view of another embodiment of the female element of the clip of the present invention.

In FIG. 5 another embodiment of the female element is shown which might be suitable for use as a tie-down for a tarpaulin or the like. The structure is substantially that shown in FIG. 2 having an oval ring 145 and an outer rim 147. For use as a tie-down, a single lug 149 would frequently be sufficient.

Many variations can be made in the structure shown without departing from the spirit of this invention. For instance, the male element of FIGS. 2–4 is shown as hollow but this is only for the saving of material and it might be solid as is shown in FIG. 1. Further, although the oval structure shown in FIGS. 2–5 is preferred because of its pleasing appearance, good grasp on the material, and freedom from tearing, this particular shape is not necessary and the plug and mating hole might be rectangular or of other elongated shapes which would permit the entire male element to pass through the female element and be reversed upon itself to coming into gripping arrangement.

One particularly useful embodiment of the present invention is that shown in FIG. 5 which is particularly adapted for use in holding tarpaulins on trucks, haystacks or the like wherein the female element has only a single fastening lug. For such a structure, the male element might have no lugs at all.

It is apparent from the description of the present invention that the elements need not be flexible. Thus, they can be cast or otherwise fabricated from stiff, hard plastic or even metal. However, they can be fabricated of a yieldable plastic such as polyethylene in many applications.

Although in each instance, some form of fastening element has been shown on either or both of the male and female elements, this is not necessary and the clip of the present invention could be used merely for holding two sheets of fabric or the like together.

I claim:

1. A fastener for attaching to a web of flexible material comprising in combination:

a. a rigid female element comprising a collar having a sidewall (136) forming a central opening of elongated shape and a flat outturned rim surface (133) surrounding said sidewall at a right angle thereto, b. a rigid male element having a plug portion (125) which is complementary to the opening of said female element and having an outturned rim (127) extending around said plug, said outturned rim having a flat surface adapted to lie against the flat outturned rim surface of the female element, c. the shape and dimensions of said male element being such that it can be turned in one position and passed through the collar of the female element without distorting either the male or female elements and turned back against said female element whereupon said rims of the male and female element lie in flat parallel configuration, d. whereby a web of flexible material such as fabric can be grasped between the male and female elements, completely around the rim peripheries of both elements.

2. The fastener of claim 1 wherein the female element has at least one opening for receiving a rope or the like.

3. The fastener of claim 2 wherein the female element has an outwardly directed lug having said opening therein.

4. The fastener of claim 3 wherein the female element has 2 lugs located 180° apart.

5. The fastener of claim 3 wherein the male element has 2 lugs located 180° apart.

6. The fastener of claim 1 wherein the male element has at least one opening for receiving a rope or the like.

7. The fastener of claim 2 wherein the male element has an inwardly directed lug having an opening therein.

8. The structure of claim 1 wherein the mating elements are oval in shape.

* * * * *